US006752477B2

(12) United States Patent
Goldberg

(10) Patent No.: US 6,752,477 B2
(45) Date of Patent: Jun. 22, 2004

(54) PORTABLE WORK STATION FOR A LAPTOP COMPUTER

(75) Inventor: Mark Goldberg, Lido Beach, NY (US)

(73) Assignee: Systemax Inc., Port Washington, NY (US)

( * ) Notice: Subject to any disclaimer, the term of this patent is extended or adjusted under 35 U.S.C. 154(b) by 210 days.

(21) Appl. No.: 10/002,058

(22) Filed: Oct. 25, 2001

(65) Prior Publication Data

US 2003/0080655 A1 May 1, 2003

(51) Int. Cl.[7] ..... A47B 81/00
(52) U.S. Cl. ..... 312/290; 312/351.1; 312/223.6
(58) Field of Search ..... 312/290, 223.6, 312/223.3, 257.1, 287, 289, 194, 196, 208.3, 249.1, 249.8, 293.2, 351.1, 351.3, 351.7

(56) References Cited

U.S. PATENT DOCUMENTS

| | | | | | |
|---|---|---|---|---|---|
| 3,184,207 | A | * | 5/1965 | Hermanns et al. | 248/413 |
| 3,794,397 | A | * | 2/1974 | Flototto | 312/231 |
| 3,984,162 | A | * | 10/1976 | Zozzaro | 312/100 |
| 4,108,517 | A | * | 8/1978 | Tomalinas et al. | 312/297 |
| 5,102,209 | A | * | 4/1992 | Hesseltine | 312/290 |
| 5,378,058 | A | * | 1/1995 | Tessmer | 312/298 |
| 5,518,310 | A | * | 5/1996 | Ellman et al. | 312/249.12 |
| 5,577,818 | A | * | 11/1996 | Sayre | 312/235.8 |
| 5,980,008 | A | * | 11/1999 | Stoever | 312/351.12 |

FOREIGN PATENT DOCUMENTS

| | | | | |
|---|---|---|---|---|
| FR | 670.579 | * | 11/1929 | 312/290 |
| GB | 315050 | * | 7/1929 | 312/290 |

* cited by examiner

*Primary Examiner*—James O. Hansen
(74) *Attorney, Agent, or Firm*—Gibbons, Del Deo, Dolan, Griffinger & Vecchione, P.C.

(57) ABSTRACT

A work station that includes a mobile cabinet and a storage compartment. The storage compartment rests on top of the cabinet and is secured to the cabinet. The storage compartment projects beyond a periphery of the topside of the cabinet. The storage compartment includes a bottom, sidewalls and a lid. The bottom may be secured to the topside of the cabinet. The sidewalls extend upwardly from the bottom on three sides. The lid has a front from which extends a front side. The lid may be hinged to two opposing ones of the sidewalls and be swung between an open position and a closed position. Between the lid and the cabinet is a surface with an opening.

9 Claims, 8 Drawing Sheets

PORTABLE WORK STATION FOR A LAPTOP COMPUTER

BACKGROUND OF THE INVENTION

1. Field of the Invention

The invention relates to a portable work station for a laptop computer that stores the laptop computer in a secure manner without requiring disconnection of cords between the laptop computer and either the electrical outlet, periphery computer equipment, telephone jacks or other terminal connections.

2. Discussion of Related Art

Conventional workstations generally are designed to remain in a fixed location. They may include a desk portion and a hutch portion. Although some may include wheels or coasters, they are still bulky and awkward to move about a carpeted floor.

Such conventional workstations are intended to accommodate a desktop computer, which is too heavy and bulky to be considered portable. On the other hand, a laptop computer is portable. Although it may be accommodated by the conventional workstations, it is accommodated in the same manner as the desktop computer. This means that the laptop computer is used on a generally fixed or stationary workstation. Such is counter to one of the most appealing attributes of the laptop computer which the desktop computer lacks: portability.

One concern to a user of a laptop computer is security. Unauthorized persons may enter office buildings at lunch time or at quitting time to quickly grab a laptop computer. Unlike the desktop computer, a laptop computer is easily folded and carried away. Indeed, office building security may not realize that an unauthorized person is carrying the laptop computer away if the laptop computer is slipped into a carrying case or briefcase of the person. Even if building security did suspect theft, such a person would have a fair chance of escaping by running away with the laptop computer. On the other hand, the desktop computer, because of its size and weight, is not so easily carried away without causing building security to become suspicious. Such a person would not have an easy time escaping with the desktop computer if confronted by building security.

Another concern is inconvenience. Although conventional computer stations do have sliding drawers that lock, such drawers must be wide enough to contain the laptop computer if they are to secure the laptop computer. Further, they are somewhat inconvenient for storing the laptop computer since the user needs to disconnect computer cords from the laptop computer in order to place the laptop computer into the drawer and then reconnect them when the laptop computer is to be used.

Further, while the laptop computer is in use, an empty drawer is a tempting place for the user to store items. Such items would then need to be removed to provide sufficient space in the drawer to accommodate the laptop computer when not in use. Emptying such a drawer is inconvenient to the user. The alternative of keeping such a drawer empty is likewise inconvenient if the user needs to store items.

It would therefore be desirable to provide for a cabinet that is portable, lightweight and provides secure storage for a laptop computer in such a way as to discourage a user from filling the storage space with other items during use of the laptop computer and yet avoids the need to disconnect computer cords to secure the laptop computer.

BRIEF SUMMARY OF THE INVENTION

One aspect of the invention resides in a work station that includes a mobile cabinet and a storage compartment. The storage compartment rests on top of the cabinet and is secured to the cabinet. The storage compartment projects beyond a periphery of the topside of the cabinet. The storage compartment includes a bottom, sidewalls and a lid. The bottom may be secured to the topside of the cabinet. The sidewalls extend upwardly from the bottom on three sides. The lid has a front from which extends a front side. The lid may be hinged to two opposing ones of the sidewalls and be swung between an open position and a closed position.

The laptop computer is accommodated on the bottom, within the confines of the sidewalls. When the top is swung to the open position, the hinge keeps the top in such an open position, permitting a user access to the laptop computer. When the lid is swung to the closed position, the laptop computer is completely contained within the storage space bounded by the bottom, sidewalls and lid. The front side of the lid may have a key lock with an elongated strip that rotates into and out of an opening in the bottom to lock or release the lid from the cabinet.

BRIEF DESCRIPTION OF THE SEVERAL VIEWS OF THE DRAWING

For a better understanding of the present invention, reference is made to the following description and accompanying drawings, while the scope of the invention is set forth in the appended claims.

DETAILED DESCRIPTION OF THE INVENTION

Figure 1:
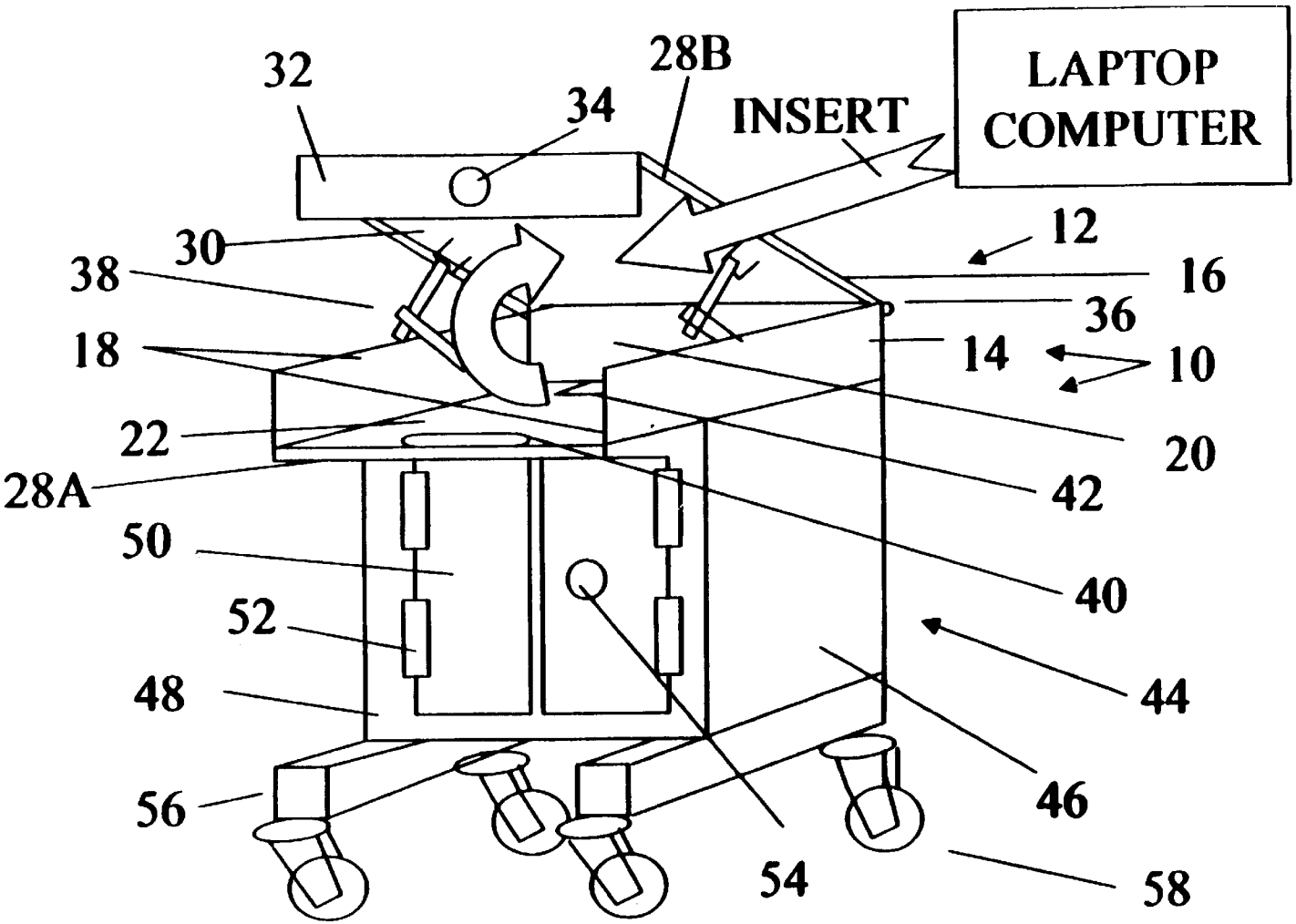
FIG. 1 is a front perspective view of the workstation in accordance with the invention.
Figure 2:
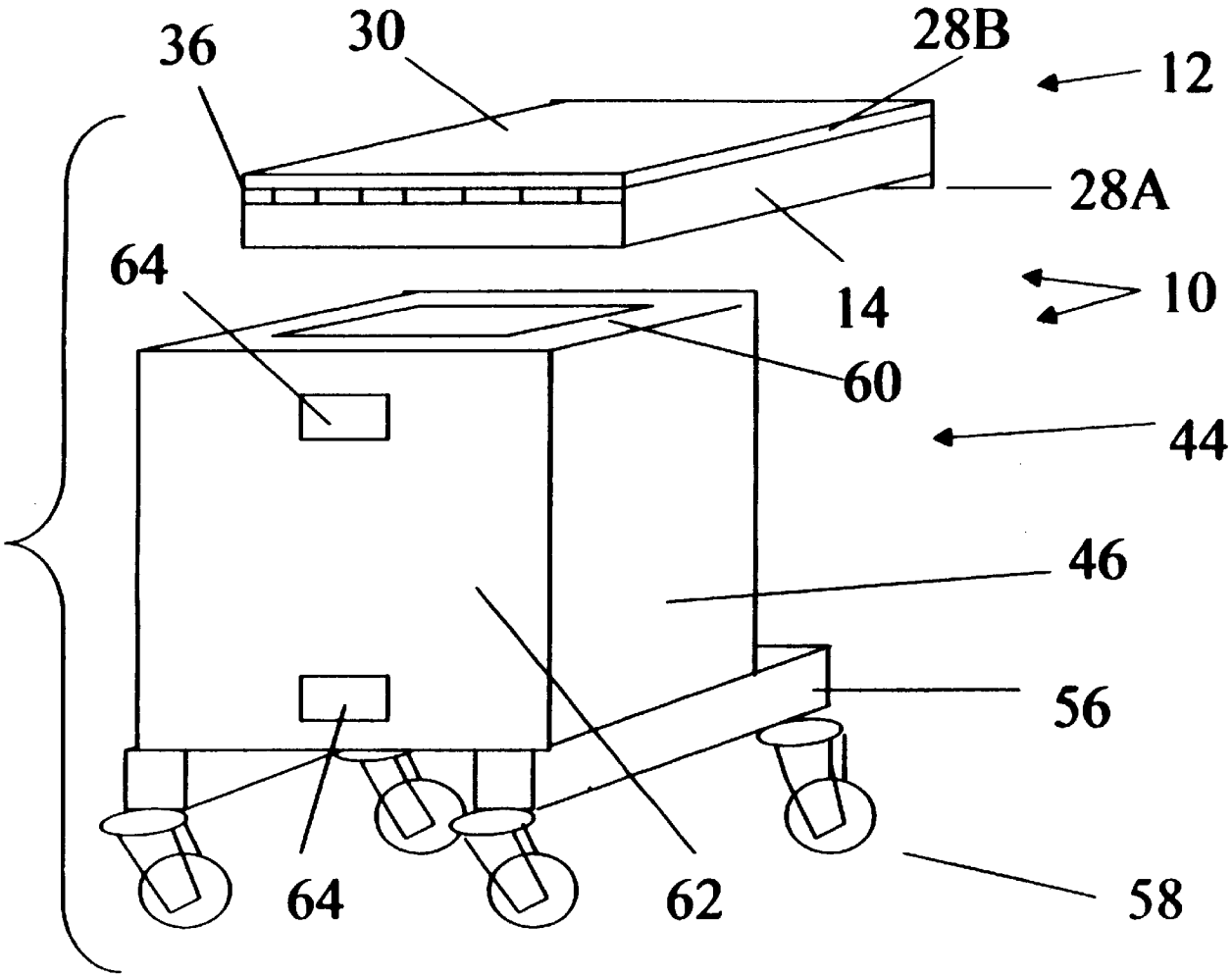
FIG. 2 is an exploded, rear perspective view thereof.
Figure 3:
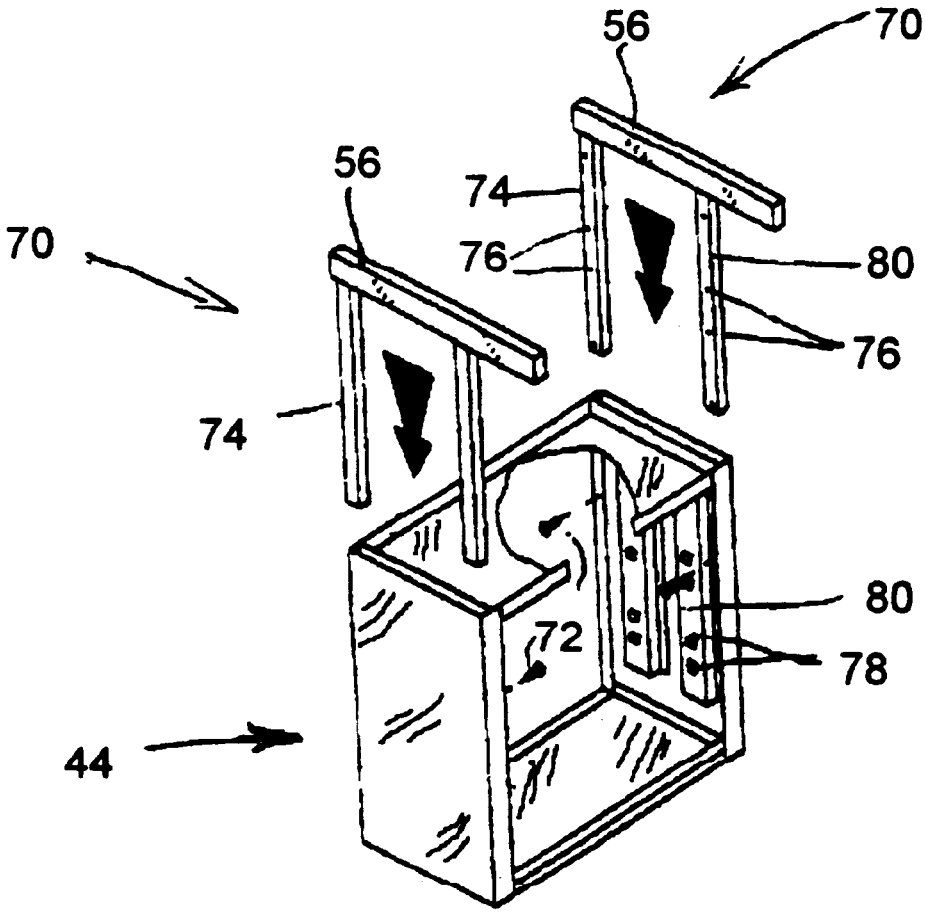
FIGS. 3–7 are perspective views showing assembly of the invention.

Turning to the FIGS. 1 and 2, a work station 10 is shown that includes a storage compartment 12, which has a base 14 and a lid 16. The base 14 has two opposing sidewalls 18, a rear 20, and bottom 22 with a lock opening 24, a cord opening. 26 and a depending front lip 28A. The lid 16 has a cover 30 with two depending lips 28B. The lid 16 has a front 32 with a key lock 34. The base 14 and the lid 16 are secured to each other by a hinge 36. Two hinged locking bracket mechanisms 38 are provided that are of conventional manufacture. They each are secured to respective connectors on the inside of the cover 30 to respective inside surfaces of the two opposing sidewalls 18 of the base 14. The bottom 22 includes a hole 40 in line with an elongated strip (not shown but of conventional design) that turns in unison with the rotation of the lock 34 in a conventional manner. The strip is inwardly of the front side 24. The bottom 22 also includes an opening 42 through cords extend from a laptop computer to an electrical outlet or peripheral computer devices or phone jacks or other terminal connections.

The storage compartment 12 is secured to a cabinet 44. The cabinet 44 includes two opposing sidewalls 46, a front panel 48 with storage doors 50 that are secured via hinges 52 to the front panel 48. A key lock 54 may be provided on at least one of the cabinet doors to enable locking and unlocking of the cabinet doors. The key lock 54 is of conventional manufacture and operates in a conventional manner. That is, an elongated strip rotates in response to turning of the lock with the key to either reside in an inner slot on the opposite storage door 50 or be clear of it, depending upon the relative turning of the key lock 54. The cabinet 44 is secured to two rails 56, to which are secured four coasters or wheels 58.

FIG. 2 shows the cabinet 44 is open at the top, with only depending folds 60 on which rests and to which is secured the bottom 22 of the storage compartment 12. The rear 62 of the cabinet 44 has tow spaced apart apertures 64 to accommodate insertion of desired cords between the laptop computer and either computer peripheral devices, phone jacks, electrical outlets or other terminal connections. The depending folds 60 may have a series of holes (not shown) to accommodate insertion of fasteners (not shown) through like holes (not shown) in alignment through the bottom of the storage compartment 12.

The storage compartment 12 is in a fully closed position. The lid 16 of the storage compartment 12 may be swung to a fully open position (not shown) in which the lid 16 is substantially perpendicular to the bottom 22. The direction of rotation is indicated by the curved arrow in FIG. 1. By swinging the lid 16 in the opposite direction, it may reach the fully closed position of FIG. 2 in which the lips 30 overlie the opposing sidewalls 18 and the front 32 closes the gap between the two forward edges of the opposing sidewalls 18. The rear of the lid 16 is hinged to the rear 20 across its full length by the hinge 36. Since the laptop computer is placed in the storage compartment 12 while in use, it discourages filling the storage compartment with other items which a user might otherwise be tempted to do for convenience. As such, the storage compartment 12 is likely to remain clutter-free since it accommodates the laptop while in use as well as while not in use.

As is evident from the drawing, the bottom 22 of the storage compartment 12 extends beyond the forward periphery of the top of the cabinet 44. Similarly the rails 46 project beyond the forward periphery of the bottom of the cabinet 44. This arrangement enables the user to sit while using the workstation with the user's legs beneath the overhang provided by the projecting portion of the bottom 22 and yet enable placement of the laptop computer on the topside of the bottom 22 at a location above where the user's legs will be beneath the overhang.

If desired, the lock 34 may be replaced by a conventional locking mechanism known from conventional brief cases and may use a combination lock instead of a key lock, except that the locking would need to arise between the front of the lid and either the sidewalls or bottom of the storage compartment. The locking brackets 38 may be of the same conventional manufacture as found in conventional brief cases. Indeed, the overall construction is comparable to securing a conventional briefcase of large enough dimension atop a cabinet, provided necessary holes in the brief case and topside of the cabinet for extending the computer cords were provided. Also, the front of the briefcase would need to entirely rise with the lid so as to leave an unobstructed front opening to access the laptop computer.

The cabinet 44 may have shelves inside that are accessible through the doors 50. Computer peripheral equipment, such as printers, scanners, or the like, may be stored on the shelves and connected to the laptop computer via appropriate cords. The cords may extend through the apertures 64 and through the open top of the cabinet and through the opening 42 in the storage compartment 12.

FIGS. 3–7 show a sequence of steps to assemble the work station of FIGS. 1 and 2.

Figure 8:
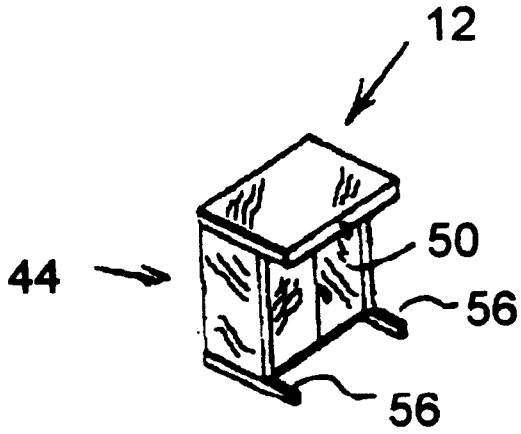
FIGS. 8 and 9 show perspective views of the invention in a fully assembled condition in a lowered state (FIG. 8) and in a raised state (FIG. 9).
Figure 9:
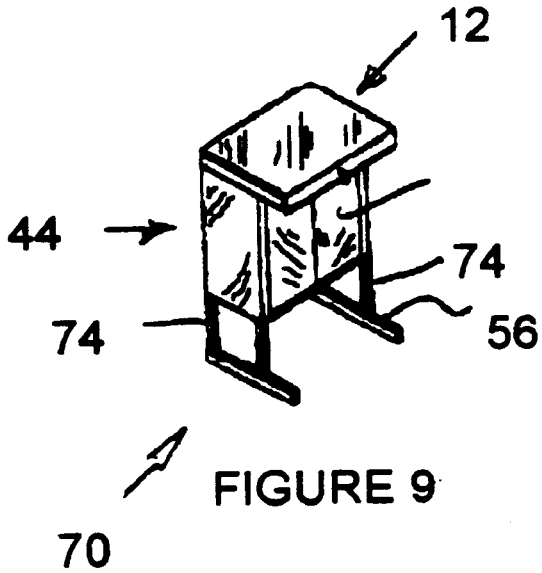

First, legs 70 are attached to the cabinet 44 with fasteners 72. The legs 70 have respective rails 56 and each has two elongated members 74 that extend in a manner perpendicular to the rail 56. The elongated members 74 each have spaced apart fastener holes 76 that allow the fasteners 72 to secure to any desired one of the holes 76 and into an aligned opening 78 in a bracket 80 attached to inside of a wall of the cabinet. Depending upon which holes 76 are to align with the openings 78 to which is secured the fasteners 72, the cabinet can either rest on the rails 56 (FIG. 8) or be raised from them (FIG. 9).

Figure 4:
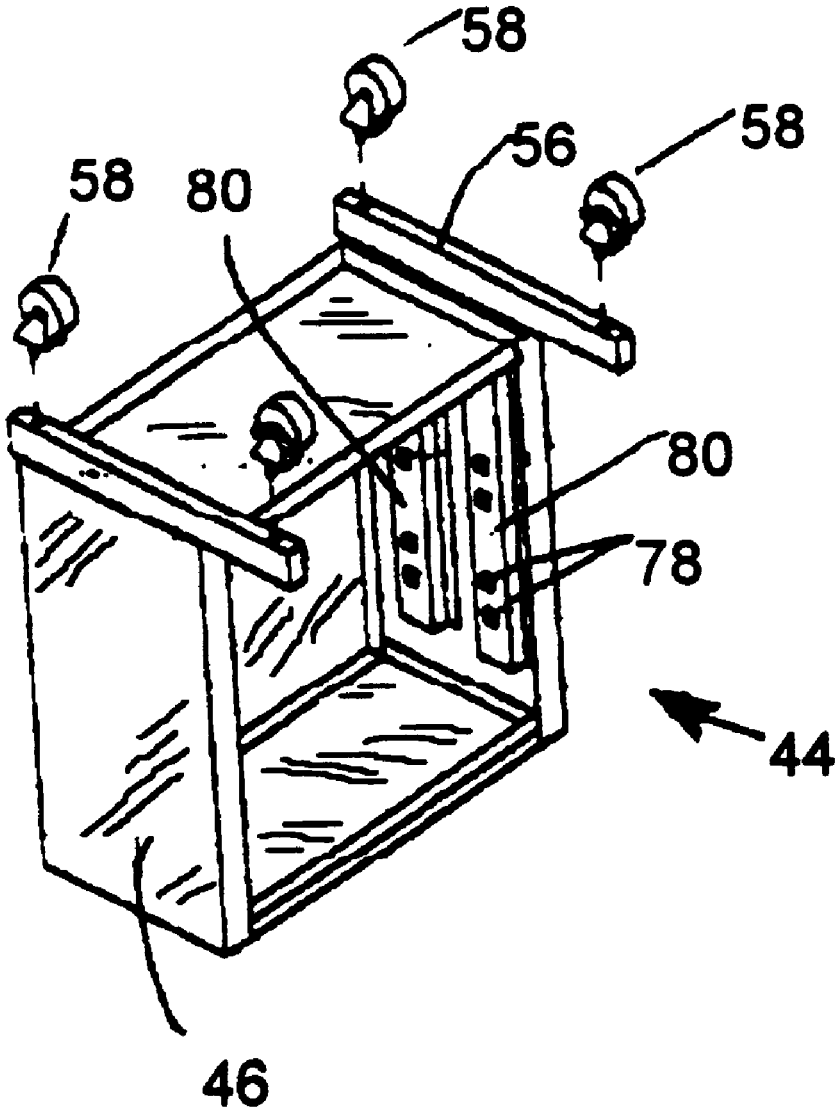

Next, the wheels or coasters 58 are attached to the rails 56, as shown in FIG. 4, so that assembly is in the same manner as any conventional wheels or coasters could be attached to rails.

Figure 5:
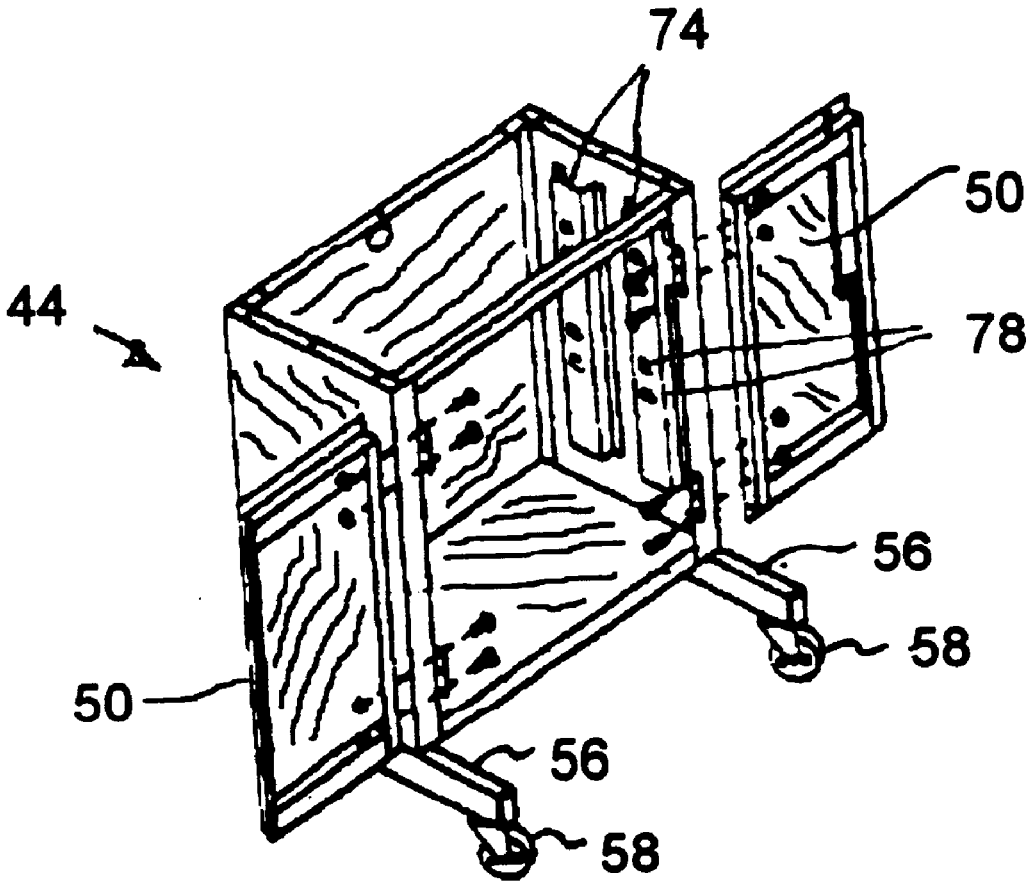
Figure 6:
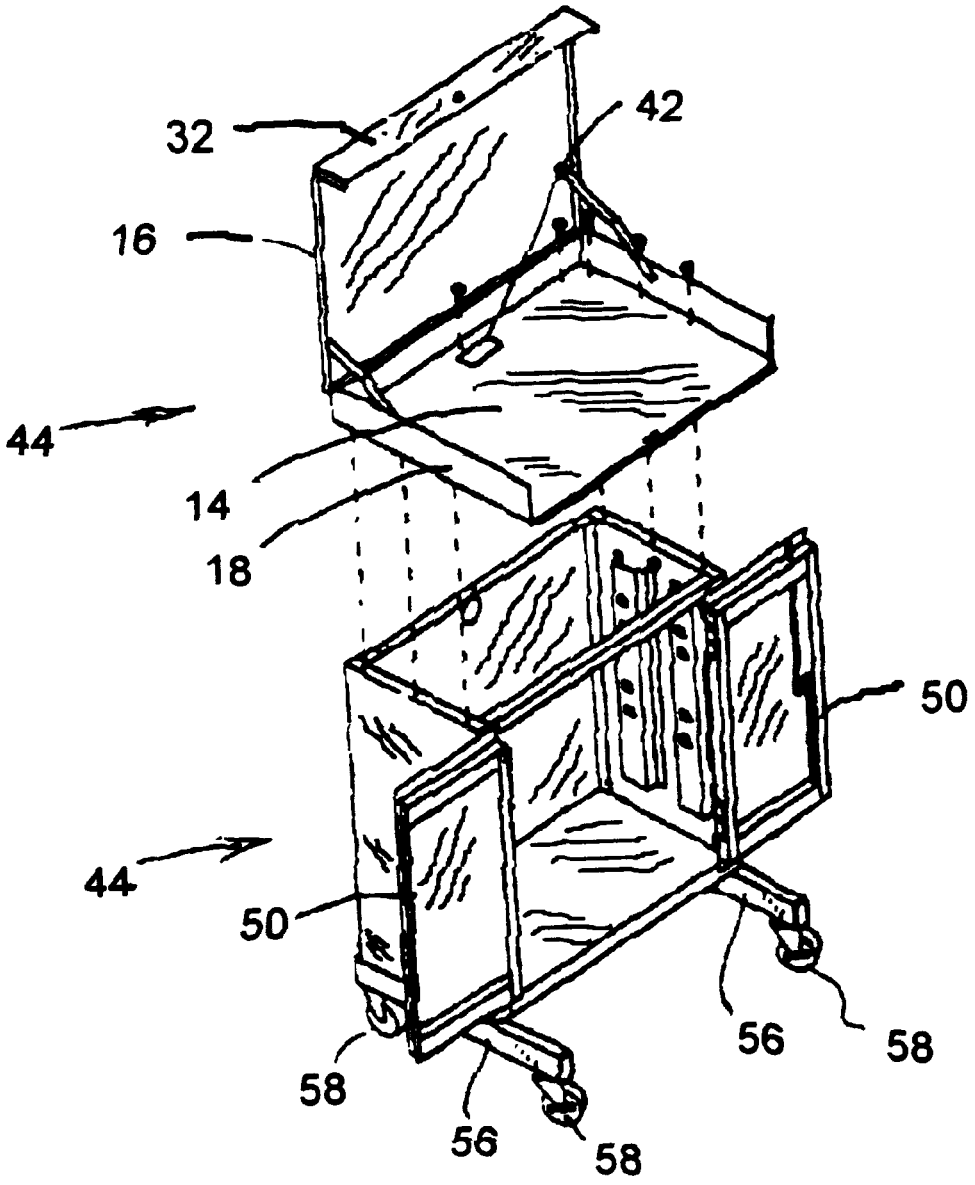
Figure 7:
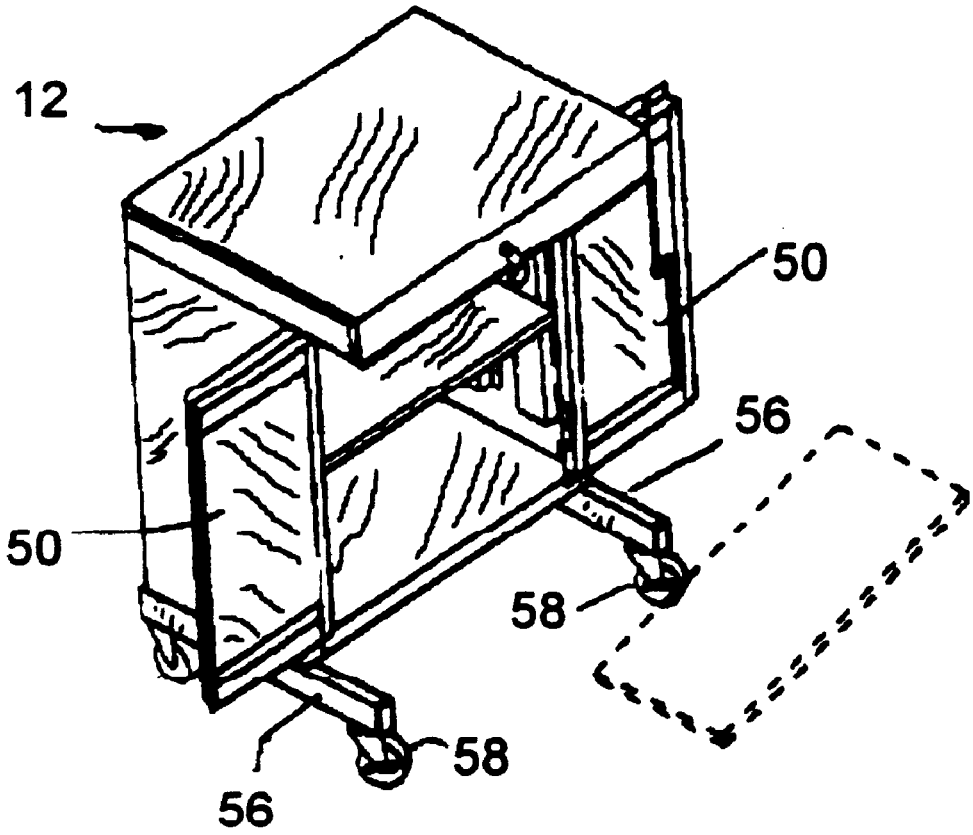

Thereafter, the cabinet storage doors 50 as attached to the cabinet front panel 48 as shown in FIG. 5. The bottom 22 of the storage compartment 12 is then attached to the depending folds 60 of the cabinet 44 as shown in FIG. 6. Finally, the shelving is inserted into the cabinet 44 as shown in FIG. 7.

Prior to insertion of the shelving, the cabinet 44 may be raised off the rails 56 by unfastening any fasteners that connect the elongated members 74 to the bracket 80, moving the cabinet 44 relative to the rails 56 along the elongated members 74 to a desired elevation, and fastening the elongated members 74 and bracket 80 together with fasteners 72. The fastening takes place when the appropriate fastener holes 76 are aligned with appropriate ones of the openings 78 in the bracket 80. To lower the cabinet, the shelving is removed and the fasteners 72 are unfastened. The same sequence is followed as for raising except that the cabinet is lowered closer to the rails until different openings 78 align with the fastener holes 76 of the elongated members 74. The fasteners are then inserted into the aligned holes and openings. FIG. 9 exemplifies the cabinet in a raised position as opposed to the lowered position of FIG. 8.

While the foregoing description and drawings represent the preferred embodiments of the present invention, it will be understood that various changes and modifications may be made without departing from the spirit and scope of the present invention.

What is claimed is:

1. A workstation, comprising:

a storage compartment and cabinet combination, the cabinet having a front, a rear surface, a bottom and sidewalls, the storage compartment having a lid and a base, the base being secured to the cabinet, the lid being hinged to the base and movable between an open position to provide access to an interior of the storage compartment and a closed position that prevents access to the interior, the base having a surface at least a portion of which being between the interior of the storage compartment and the cabinet that is of a sufficient dimension to accommodate positioning of a laptop computer on the surface within confines of the base, the surface having an opening clear of fasteners and is arranged so that said interior of the storage compartment is accessible from within the cabinet via said opening, the surface projecting outward beyond the front of the cabinet so as to overhang forward of the front, and further including two spaced apart rails, said cabinet being secured to and on said rails, said rails projecting forward of said cabinet beneath said overhang.

2. A workstation as in claim 1, wherein the cabinet has at least one door that is configured and arranged to swing beneath said overhang between a closed position and an open position.

3. A workstation as in claim 1, further comprising wheels or coasters attached to said rails.

4. A workstation as in claim 1, further comprising two hinged brackets extending between said lid and said base and configured to lock said lid in a fully open position.

5. A workstation as in claim 1, wherein said lid has a front surface, further comprising a locking element attached to said front surface and arranged to engage with said base in a locking position to prevent said lid from opening and to clear said base in an unlocking position to permit said lid to open.

6. A workstation as in claim 1, wherein said rear of said cabinet has at least one opening clear of fasteners.

7. A workstation as in claim 1, further comprising elongated members extending from the rails, the cabinet having a bracket, the cabinet being securable to the elongated members via the bracket at a plurality of relative positions by aligning holes on the elongated members with openings in the bracket and inserting fasteners through the aligned holes and openings.

8. A workstation comprising:

a storage compartment, cabinet and legs, the cabinet having an open top, the storage compartment closing the open top and being secured to the cabinet, the storage compartment having a lid movable between a closed position that prevents access to an interior of the storage compartment, and a fully open position that permits access to the interior of the storage compartment, the storage compartment having a hinged bracket that is collapsible to enable the lid to close and that is lockable to keep the lid open, the cabinet being movable between at least two relative positions along the legs, the cabinet and the legs being selectively secured to each other at one of the at least two relative positions by fasteners, the cabinet and the legs being securable at another of the at least two relative positions thereafter by unfastening the fasteners at the one of the at least two relative positions, moving the cabinet and legs relative to each other to the another of the at least two relative positions and then securing the fasteners wherein the storage, compartment has an overhang portion that extends forward of the cabinet, and the legs include rails that extend forward of the cabinet beneath the overhang portion.

9. A workstation as in claim 8, further comprising a laptop computer within the storage compartment.

* * * * *